United States Patent [19]

Ishiguro

[11] Patent Number: 4,577,473

[45] Date of Patent: Mar. 25, 1986

[54] ICE PRODUCT MAKING MACHINE

[75] Inventor: Fumio Ishiguro, Toyohashi, Japan

[73] Assignee: Hoshizaki Electric Co., Ltd., Toyoake, Japan

[21] Appl. No.: 661,327

[22] Filed: Oct. 16, 1984

[30] Foreign Application Priority Data

Oct. 17, 1983 [JP] Japan ..... 58-159379[U]

[51] Int. Cl.[4] ..... F25C 1/12

[52] U.S. Cl. ..... 62/347; 62/524; 165/150; 165/171

[58] Field of Search ..... 62/347, 348, 515, 524; 165/150, 171; 29/157.3 C

[56] References Cited

U.S. PATENT DOCUMENTS

| | | | |
|---|---|---|---|
| 1,982,075 | 11/1934 | Smith | 165/171 X |
| 2,014,703 | 9/1935 | Smith | 62/515 |
| 2,638,754 | 5/1953 | Kleist | 62/515 X |
| 2,691,813 | 10/1954 | Polad | 29/157.3 C |
| 2,722,732 | 11/1955 | Sandberg | 165/171 X |
| 3,430,452 | 3/1969 | Dedricks et al. | 62/138 |
| 3,858,647 | 1/1975 | Hickman et al. | 165/171 |
| 4,379,390 | 4/1983 | Bottum | 62/354 |

*Primary Examiner*—William E. Tapolcai

*Attorney, Agent, or Firm*—Wenderoth, Lind & Ponack

[57] ABSTRACT

A freezing unit has one or more vertically arranged freezing plates having a plurality of rib-like partitions extending in the downflow direction of the ice-making water, and a meandering cooling coil contacted with the reverse side or sides of said freezing plate or plates and composed of a plurality of straight sections connected together by bends. The straight sections are flattened on lateral side portions, while at least the terminal portions of the bends contiguous to the straight sections are flattened on lateral side portions to a thickness approximately equal to the thickness of the flattened lateral side portions of the straight sections. The flattened lateral side portions of both the straight sections and the bends are contacted with the back side or sides of the freezing plate or plates.

1 Claim, 10 Drawing Figures

ICE PRODUCT MAKING MACHINE

BACKGROUND OF THE INVENTION

This invention relates to an ice product making machine or apparatus and more particularly to an improved freezing unit therefor in which the volumetric efficiency of the unit can be increased by the construction of the meandering cooling coil provided to a substantially upright freezing plate in which the bends of the cooling coil do not protrude beyond the region of the freezing plate.

The typical construction of the vertical type ice product making machine or apparatus with a substantially upright freezing plate is shown in FIGS. 1 and 2.

In the prior-art ice product making machine shown in FIGS. 1 and 2, a freezing unit 1 is comprised of a generally box-like freezing mold 2 and a refrigerant pipe or cooling coil 3 affixed to the back side of the mold 2. The freezing mold 2 has a large number of freezing cells 4 defined by vertical partition plate members 2*b* and downwardly inclined horizontal partition plate members 2*a*. The freezing mold 2 is fabricated in its entirety of copper or the like thermal conductive material.

The above described freezing mold 1 is built into an outomatic ice product making machine shown in FIG. 1 A water saucer or reservoir 5 is provided at a lower portion of the automatic ice product making machine 1. The ice-making water filled in the tank 5 is supplied to the freezing mold 2 by means of a circulating pump 6 via a connecting hose 7 and a water feed tube 8. The refrigerant or cooling medium is supplied into the coil 3 through a compressor 10 and a condenser 11 provided in a housing 9 so that the mold 2 is chilled and the ice cubes are formed in the cells 4, these ice cubes being then stored in an ice cube storage tank 12 provided in the lower portion of the housing 9.

This known ice product making apparatus has a serious drawback that the freezing mold 2 is highly sophisticated in structure thus raising the costs of the overall apparatus.

The arrangement shown in FIGS. 3 (A) and (B) has been proposed as a means for obviating the drawback of the above described conventional device.

A strip 2 of a metal material having lower thermal conductivity, such as stainless steel, is formed with uniformly spaced apart rib-like partitions 2*c*. A pair of such strips 2 are placed vertically with their back sides 2*d* facing to each other and a meandering refrigerant pipe or cooling coil 3 is provided in such a manner that straight sections 3*a* of the cooling coil 3 are disposed within the interstice 2*e* defined between the plates 2 while bent parts 3*b* interconnecting these straight sections 3a are disposed exteriorly of the side edges 2*f* of the freezing plates 2.

During the ice-making process, as the ice-making water is supplied from the water feed pipe 8 (see FIG. 7) disposed at the upper portion of the interstice 2*e* defined between the freezing plates 2, each separate semi-cylindrical ice product 2*h* is formed at a portion of each flat freezing section 2*g* that is contacted by each transverse section 3*a* of the cooling coil 3, as shown at B in FIG. 3, with the axis of the half cylinder aligned with that of the associated straight section 3*a*.

The vertical type freezing mold shown in FIG. 3 may be freed of the deficiencies of the prior-art device shown in FIGS. 1 and 2. However, while the straight sections 3*a* are flattened on either sides at 3*c* for contacting with the back sides 2*d* of the freezing plates 2, the bends 3*b* are toroidal and project exteriorly of the side edges 2*f* of the freezing plates 2. The result is that the freezing mold 1 becomes bulky and the dead volume of the mold 1 is increased, thus proving to be a great hindrance in the construction of the small-sized ice-product making machine or apparatus.

SUMMARY OF THE INVENTION

It is a principal object of the present invention to provide an effective means whereby the aforementioned various deficiencies may be eliminated. According to an essential feature of the present invention, the bent parts of the cooling coil are also provided with flattened portions continuous with the flattened portions of the straight sections so that the extent the bends project from the side edges of the freezing plate may be reduced to the smallest value possible.

DESCRIPTION OF THE PREFERRED EMBODIMENTS

The freezing unit or mold according to the present invention is hereinafter explained by referring to the accompanying drawings, in which the same numerals are used to depict the same or equivalent parts.

Figure 1:
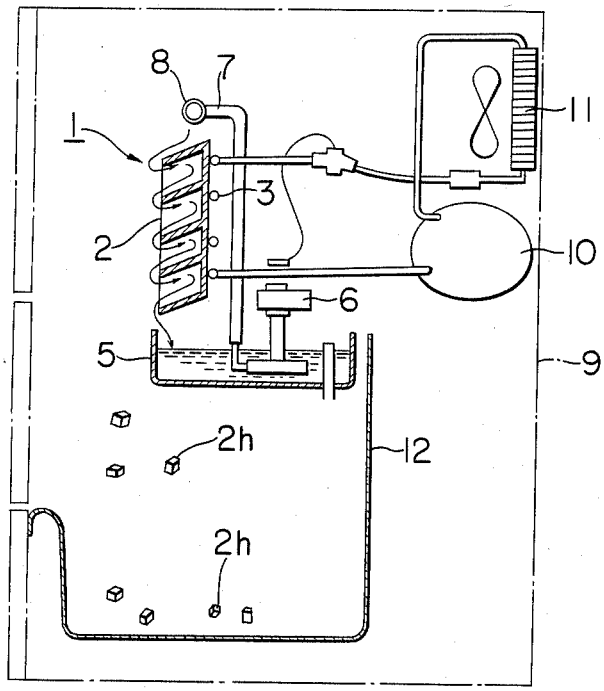
FIG. 1 (PRIOR ART)
FIG. 1 is a schematic side elevation showing the overall ice product making machine according to the prior art.
Figure 2:
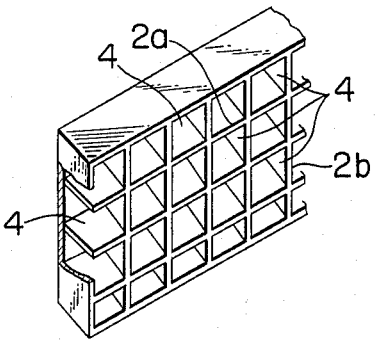
FIG. 2 (PRIOR ART)
FIG. 2 is a perspective view of the freezing mold employed in the ice product making machine shown in FIG. 1.
Figure 3A:
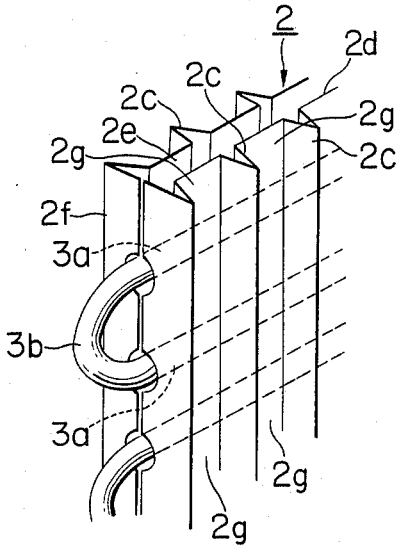
FIG. 3A (PRIOR ART)
FIGS. 3 (A), (B) show a portion of another example of the freezing mold according to the prior art, in a partial perspective view and a cross-sectional view, respectively.
Figure 3B:
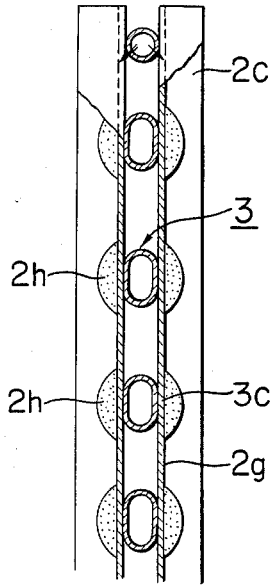
FIG. 3B (PRIOR ART)
Figure 4:
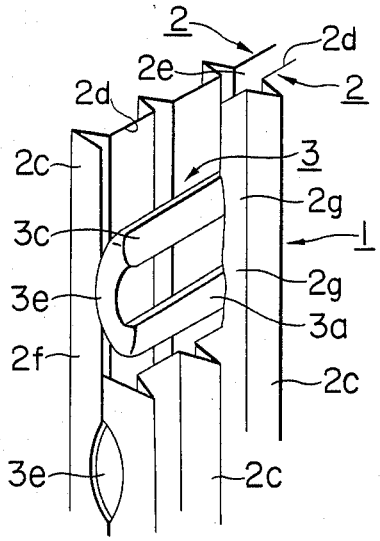
FIG. 4 is a partial perspective view of the freezing mold according to the present invention.

Referring to FIG. 4, a freezing unit or mold 1 has a pair of substantially upright freezing plates 2 and a meandering refrigerant pipe or cooling coil 3. Each freezing plate 2 is fabricated of a metal material of lower thermal conductivity, such as stainless steel. Each freezing plate 2 has a plurality of partitions 2*c* in the form of ribs or projections that extend vertically and are spaced apart transversely from one another for interrupting thermal conduction axially of the coil which is caused through direct mechanical contact of the freezing plate with the cooling coil 3. The freezing plates 2 are arranged with their back sides facing to each other, and the meandering cooling coil 3 is sandwitched in a narrow interstice defined between these freezing plates 2.

Figure 5A:
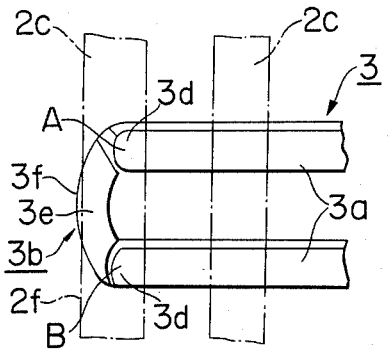
FIG. 5(A) is a front view showing the cooling coil shown in FIG. 4.
Figure 5B:
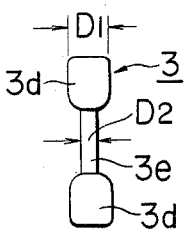
FIG. 5(B) is a left side view of FIG. 5(A).
Figure 6A:
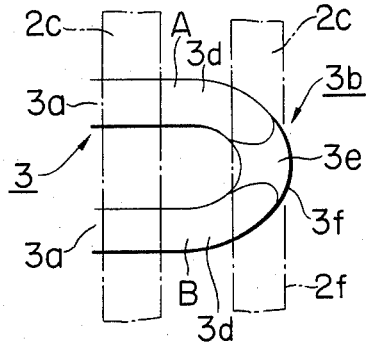
FIG. 6(A) is a front view showing another embodiment of the cooling coil.
Figure 6B:
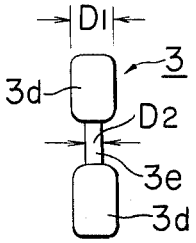
FIG. 6(B) is a right side view of FIG. 6(A).

Each cooling coil 3 has straight sections 3*a*, as shown in FIGS. 5 and 6. These sections 3*a* are flattened on the both sides 3*c* as conventionally so as to present a substantially flat cross-sectional configuration. These flattened sides 3*c* are designed to be in direct mechanical contact with the back sides 2*d* of the freezing plates 2 for chilling the flat freezing sections 2*g* defined between the adjoining partitions 2*c*.

The bends 3*b* interconnecting the adjoining straight sections 3*a* of the cooling coil 3 are formed continuously from the flattened sides 3*c* of the straight sections 3*a*, as shown in FIGS. 5 and 6 showing a first and a second embodiment of the cooling coil, respectively. The straight sections 3*a* are merged to the associated bend 3*b* at terminal portions 3*d*, which may be formed similarly to the flattened sides 3*c* and formed in substantially the same manner as the straight sections 3*a*, as shown in FIG. 5(A), or may be bent inwards towards each other as shown in FIG. 6(A). These terminal portions 3*d*, 3*d* are interconnected by a central portion 3*e* that is concave with respect to the terminal portions 3*d*, 3*d* and has a thickness $D_2$ substantially less than the thickness $D_1$ of the terminal portions 3*d*. Thus, each bend 3*b* is composed of the terminal portions 3*d*, 3*d* and the central portion 3*e*. As shown in FIGS. 5 and 6, the second partition 2*c* when counting from the left side extremity in FIG. 4 (or FIG. 5) is disposed towards the left side extremity of the straight section 3*a*, and the left side end partition 2*c* in FIG. 4 (or FIG. 5) is disposed the central portion 3*e* of the bend 3*b*. Thus the outer end 2*f* of the freezing plate 2 and the outer end face 3*f* of the central portion 3*e* of the bend 3b are substantially in the same plane and the end face 3*f* of the bend 3 does not project exteriorly of the outer end face 2*f* of the freezing plate 2.

The portions A, B of the freezing plate 2 contacting with the terminal portions 3*d*, 3*d* of the bend 3*b* represent separate portions of the associated flat freezing section 2*g*, as shown in FIGS. 5 and 6, because the central portion 3*e* of the bend 3*b* is not contacted with the freezing plate 2.

Figure 7:
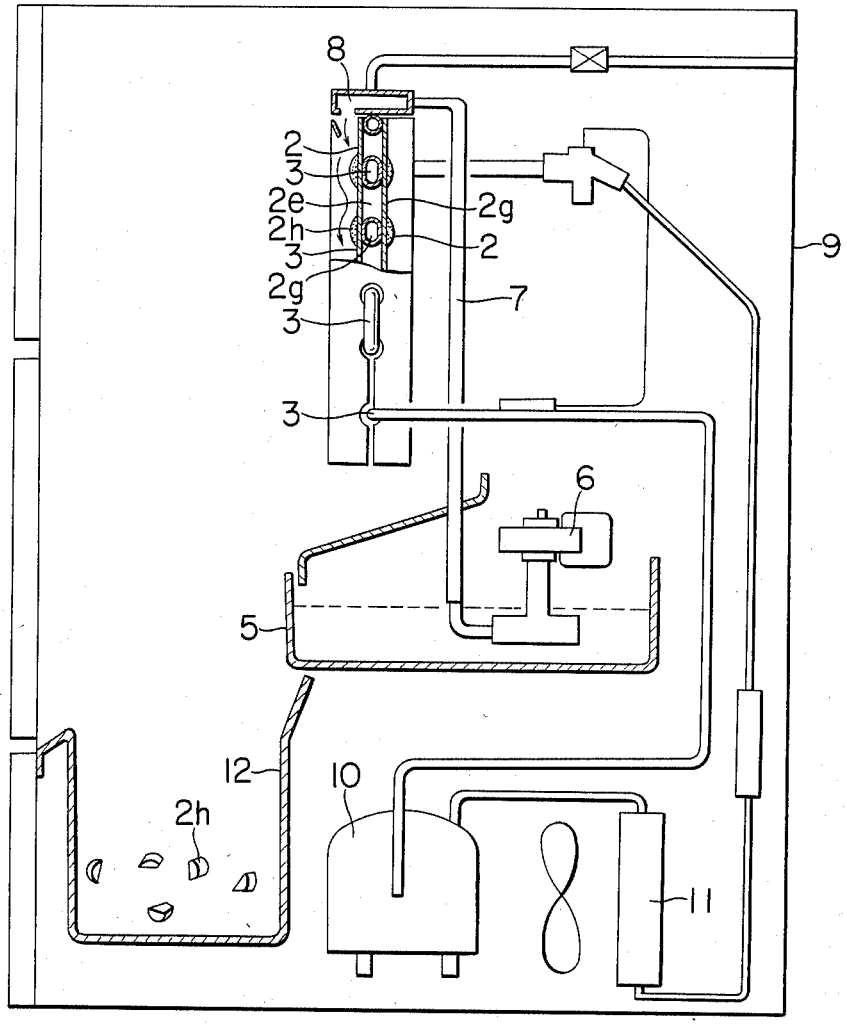
FIG. 7 is a schematic side elevation showing the freezing mold of the present invention when mounted in position in an automatic ice product making machine or apparatus.

The above described freezing mold can be built into an automatic ice product making machine or apparatus 1 shown in FIG. 7. The apparatus has a water saucer or reservoir 5 at a lower portion thereof for accommodating ice-making water. During ice making, the ice-making water in the saucer 5 is supplied by a circulating pump 6 to the surface of the freezing plate 2 via a connecting hose 7 and a water feed pipe 8.

The refrigerant or cooling medium is supplied to the cooling coil 3 via a condenser 11 and a compressor 10 provided in a housing 9. In this manner, the freezing plates 2 are chilled, and a number of substantially semi-cylindrical ice products 2h are formed on each freezing section 2*g*.

It is seen from above that, with the ice product making machine or apparatus according to the present invention, the bends of the cooling pipe which represent an unuseful area from the viewpoint of chilling the freezing plates can now be used for ice making, so that an achievement is obtained in ice-making efficiency. In addition, these bends do not protrude exteriorly of the outer end faces of the freezing plate, because the outer end face of each bend is substantially flush with the exterior end face of the freezing plate, so that the dead volume may be eliminated, and a special advantage may be achieved especially when the freezing mold is built into a small-size automatic ice product making machine. It should be noted that the desired effects may be obtained with both the first embodiment shown in FIG. 5 and the second embodiment shown in FIG. 6.

What we claim is:

1. A freezing unit for an ice product making machine which comprises one or more substantially upright freezing plates having a plurality of vertically extending and transversely spaced apart rib-like projections, and a meandering cooling coil in direct mechanical contact with the reverse side or sides of said freezing plate or plates, said cooling coil being composed of a plurality of straight sections connected together by bends, wherein the straight sections are flattened on lateral side portions, the terminal portions of said bends contiguous to said straight sections are flattened on lateral side portions to a thickness approximately equal to the thickness of the flattened lateral side portions of the straight sections, the central portions of said bends being of a lesser thickness than the thickness of said flattened lateral side portions of said straight sections and wherein the flattened lateral side portions of the said straight sections and the terminal portion of said bends contiguous to said straight sections are in direct mechanical contact with the back side or sides of said freezing plate or plates and said central portions of said bends are substantially out of contact with said freezing plate or plates.

* * * * *